US009534393B2

(12) United States Patent
Cittadine

(10) Patent No.: US 9,534,393 B2
(45) Date of Patent: Jan. 3, 2017

(54) RETRACTABLE COVER

(71) Applicant: Jack P. Cittadine, Elkhart, IN (US)

(72) Inventor: Jack P. Cittadine, Elkhart, IN (US)

( * ) Notice: Subject to any disclaimer, the term of this patent is extended or adjusted under 35 U.S.C. 154(b) by 64 days.

(21) Appl. No.: 14/693,526

(22) Filed: Apr. 22, 2015

(65) Prior Publication Data

US 2015/0300025 A1 Oct. 22, 2015

Related U.S. Application Data

(60) Provisional application No. 61/982,459, filed on Apr. 22, 2014.

(51) Int. Cl.

| | |
|---|---|
| ***E04F 10/10*** | (2006.01) |
| ***E04F 10/06*** | (2006.01) |
| ***E06B 9/62*** | (2006.01) |
| ***E04H 15/00*** | (2006.01) |

(52) U.S. Cl.

CPC ..... *E04F 10/0618* (2013.01); *E04F 10/0651* (2013.01); *E04F 10/0662* (2013.01); *E04H 15/00* (2013.01); *E06B 9/62* (2013.01)

(58) Field of Classification Search

CPC ... B60P 3/343; E04F 10/0618; E04F 10/0651; E04F 10/0692; E04F 10/0655; E04F 10/0622; E04F 15/06

USPC ..... 114/361; 160/79, 59, 66, 67, 69, 70, 78, 160/54, 55, 241, 262

See application file for complete search history.

(56) References Cited

U.S. PATENT DOCUMENTS

| | | | | | |
|---|---|---|---|---|---|
| 245,651 | A * | 8/1881 | Meech | E04H 15/48 | 114/361 |
| 2,634,740 | A * | 4/1953 | Duke | B63B 17/02 | 114/361 |
| 3,075,805 | A * | 1/1963 | Golde | B60J 7/0015 | 160/262 |
| 3,312,990 | A * | 4/1967 | Lapworth | B63B 17/02 | 114/361 |
| 3,952,758 | A * | 4/1976 | Addison | B60P 3/343 | 135/141 |
| 4,951,594 | A * | 8/1990 | Feikema | B63B 17/02 | 114/361 |
| 5,033,527 | A * | 7/1991 | Ouvrard | B60J 1/2019 | 160/265 |
| 5,044,298 | A * | 9/1991 | Pepper | B63B 17/02 | 114/361 |
| 5,056,839 | A * | 10/1991 | Yoon | B60J 11/02 | 150/166 |
| 5,380,058 | A * | 1/1995 | Short | B63B 17/023 | 114/201 R |
| 5,449,032 | A * | 9/1995 | Blevins | E04H 15/08 | 160/71 |

(Continued)

FOREIGN PATENT DOCUMENTS

BE EP 1010576 A1 * 6/2000 ..... B60P 3/343

*Primary Examiner* — Katherine Mitchell
*Assistant Examiner* — Johnnie A Shablack
(74) *Attorney, Agent, or Firm* — Botkin & Hall, LLP

(57) ABSTRACT

A retractable and stowable cover is provided for use with an open living space. A lifting mechanism moves a center section from a stored position to a second position where the cover can be used for shade. The shade position allows an expandable shade fabric to be deployed from each side of the center section. The lifting mechanism can then move the center section where it comes down and the shade fabric can then cover and secure the open space.

10 Claims, 6 Drawing Sheets

(56) References Cited

U.S. PATENT DOCUMENTS 5,479,872 A * 1/1996 Hulett ..... B63B 17/02 114/361
5,579,797 A * 12/1996 Rogers ..... A45B 11/00 135/88.01
5,832,978 A * 11/1998 Kroner ..... E04F 10/0618 160/70
6,357,379 B1 * 3/2002 Murphy, Jr. ..... B63B 17/02 114/361
6,439,150 B1 * 8/2002 Murphy ..... B63B 17/02 114/361
6,488,069 B1 * 12/2002 Mashaw ..... E04F 10/0614 160/262
6,523,770 B2 * 2/2003 Peeters ..... B60J 1/2033 160/262
6,799,529 B1 * 10/2004 Willis ..... B63B 17/02 114/361
6,983,716 B1 * 1/2006 Ankney ..... B63B 17/02 114/361
7,017,976 B1 * 3/2006 Rutherford ..... B60P 3/343 160/70
7,093,558 B1 * 8/2006 Mandanici ..... B63B 17/02 114/361
7,370,597 B1 * 5/2008 Schwindaman ..... B63B 17/02 114/361
7,520,240 B2 * 4/2009 Tufte ..... B63B 17/02 114/361
7,571,691 B2 8/2009 Russikoff
7,628,194 B2 * 12/2009 Wagner ..... E04F 10/0622 160/22
7,685,960 B1 * 3/2010 Carusello ..... B63B 17/02 114/361
7,784,420 B2 * 8/2010 Tufte ..... B63B 17/02 114/361
7,895,964 B2 * 3/2011 Russikoff ..... B63B 17/02 114/361
8,256,486 B1 * 9/2012 Thomas ..... E04F 10/0618 160/44
8,359,994 B1 * 1/2013 Highfield ..... B63B 19/18 114/361
8,752,498 B1 * 6/2014 Schwindaman ..... B63B 17/02 114/361
8,770,135 B2 * 7/2014 Craze ..... B63B 17/02 114/361
8,770,136 B2 * 7/2014 Larson ..... B63B 17/02 114/361
8,777,302 B2 * 7/2014 Kanai ..... B60J 3/02 160/262
8,857,366 B2 * 10/2014 Russikoff ..... B63B 17/02 114/361
8,911,174 B2 * 12/2014 Hey ..... B63C 3/06 114/361
9,222,278 B2 * 12/2015 Park ..... E04H 15/06
2003/0217683 A1 * 11/2003 Heckman ..... B63B 17/02 114/361
2006/0162873 A1 * 7/2006 Dao ..... B60J 11/00 160/122
2007/0137803 A1 * 6/2007 Hansen ..... B60J 1/2027 160/370.22
2008/0216970 A1 * 9/2008 Lin ..... B60J 1/205 160/262
2009/0178605 A1 * 7/2009 Tufte ..... B63B 17/02 114/361
2011/0088855 A1 * 4/2011 Boustani ..... B60J 11/02 160/370.22
2012/0261940 A1 * 10/2012 Gees ..... B60J 11/025 296/136.04
2013/0140848 A1 * 6/2013 Shanley ..... B60P 3/34 296/172
2013/0206050 A1 * 8/2013 Russikoff ..... B63B 17/02 114/361
2015/0027647 A1 * 1/2015 Dietl ..... B60J 7/0015 160/370.22

* cited by examiner

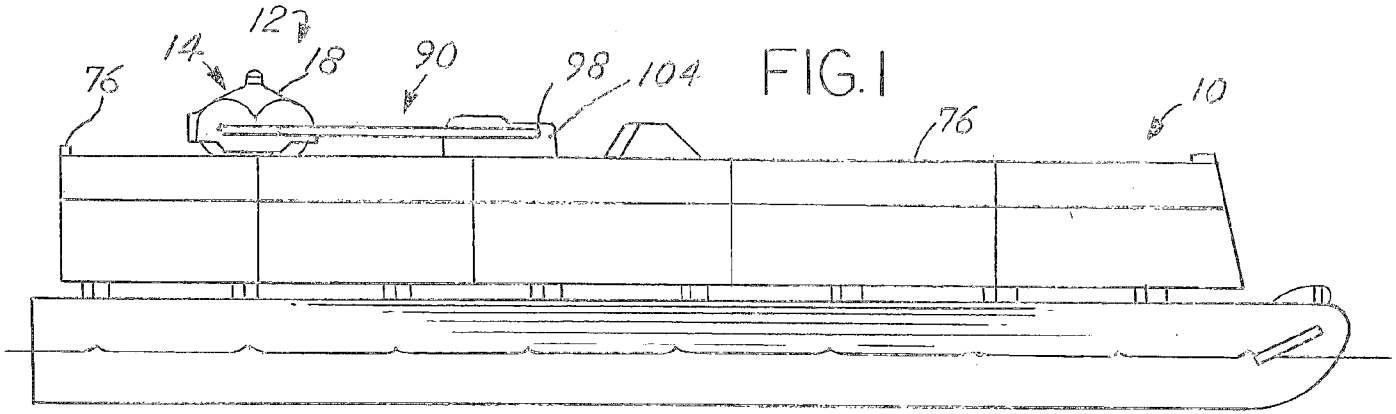
FIG. 1
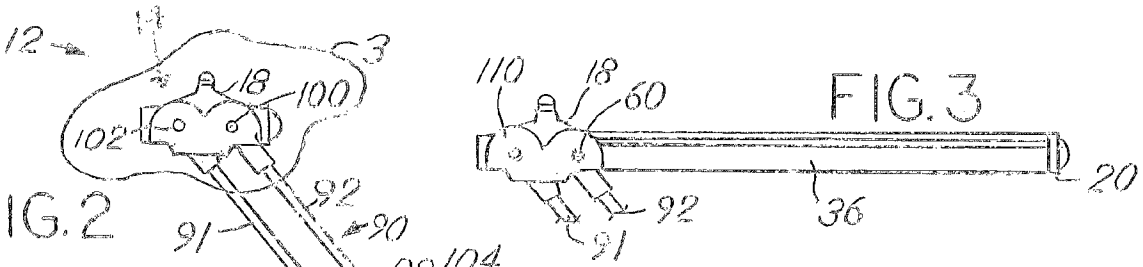
FIG. 3
FIG. 2
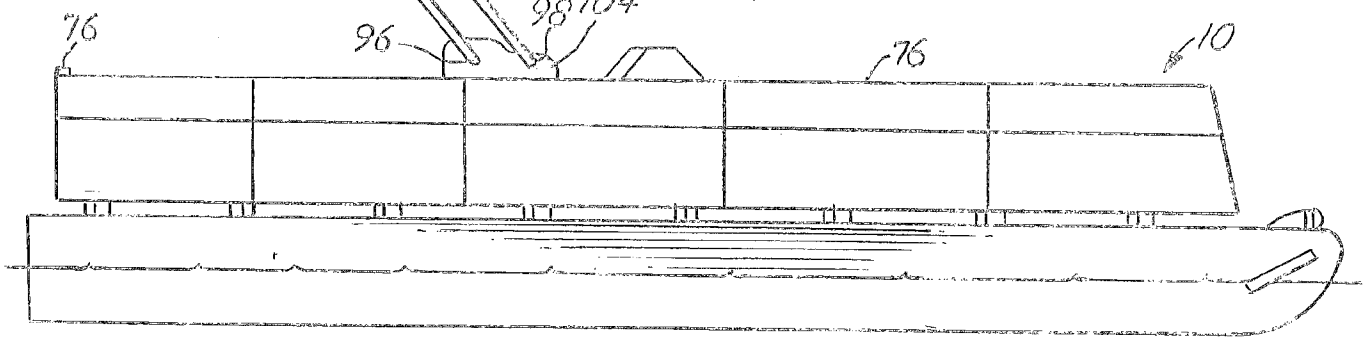

RETRACTABLE COVER

CROSS REFERENCE TO RELATED APPLICATIONS

This application claims the benefit of U.S. Provisional Application No. 61/982,459, filed Apr. 22, 2014, the disclosures of which are hereby incorporated by reference.

BACKGROUND OF THE INVENTION

This present disclosure relates to retractable covers, specifically for protecting an area from the elements and for storage. Retractable covers are used on various watercraft types, living spaces, trailers or recreational vehicles. Different types of covers exist on the market today, such as a snap down cover or foldable top. Foldable tops frequently have mechanisms that are complicated to use with snaps or latches or have only one position when in use. Expandable covers are a viable option; however they are usually limited to a straight roller to allow the fabric to roll in and out. Due to the weight of the fabric, frequently water can pool on the fabric as it is nearly impossible to pull the fabric tight enough to maintain a flat surface. Therefore, an improved cover is needed.

SUMMARY OF THE INVENTION

The present disclosure describes a convertible awning system that has a movable center section where front and rear fabric sections extend. The center section can be raised and lowered to allow for a clear area in the main area to be covered. A rear fabric section attaches to a moveable rear beam, forming a protective layer between the rear and center section. A front fabric section attaches to a moveable front beam, forming a protective layer between the front and the center section. Rollers reside in the center section that are used to wind and unwind the fabric as the front and rear sections extend and retract. The rear beam is connected to a center section with folding arms that extend as the center section is raised. The center section attaches to a forward beam with folding arms that extend as the forward beam is extended. The rollers are curved downward to generate a downward curve in the fabric as it extends outward from the center section to the forward beam and likewise to the rear. The curved fabric allows water and other material to naturally drain when the cover is in the covered position. Additionally, the forward beam and rear beam are curved downward to maintain the curvature of the fabric as it exits the center section. The rear beam has an optional removable section where the fabric attaches. This allows the rear section to cover a larger area. Optionally the cover is lockable to offer some theft protection.

BRIEF DESCRIPTION OF THE DRAWINGS

A preferred embodiment of this invention has been chosen wherein:

FIG. 1 is a side view of the cover in the stored position as mounted to a pontoon boat;

FIG. 2 is a side view of the cover moving from the stored position to the use position;

FIG. 3 is a partial view 3 of the center section with the front beam extended;

DESCRIPTION OF THE PREFERRED EMBODIMENT

Figure 4:
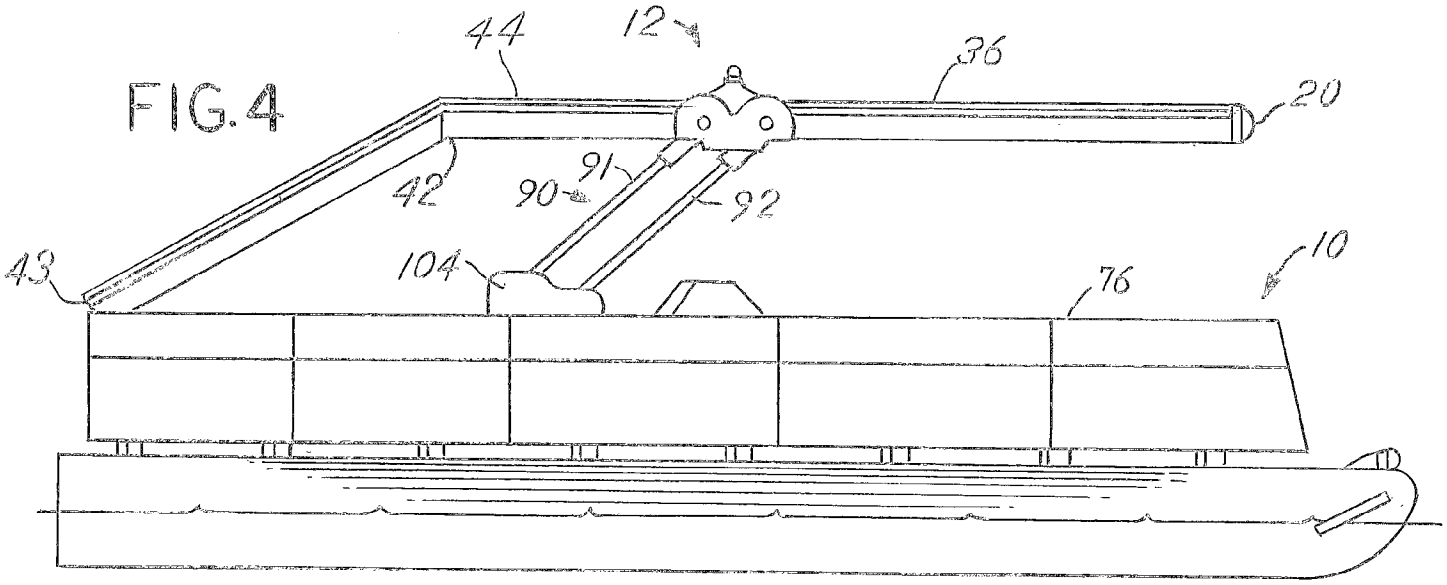
FIG. 4 is a side view of the cover moving from the use position to the covered position.
Figure 5:
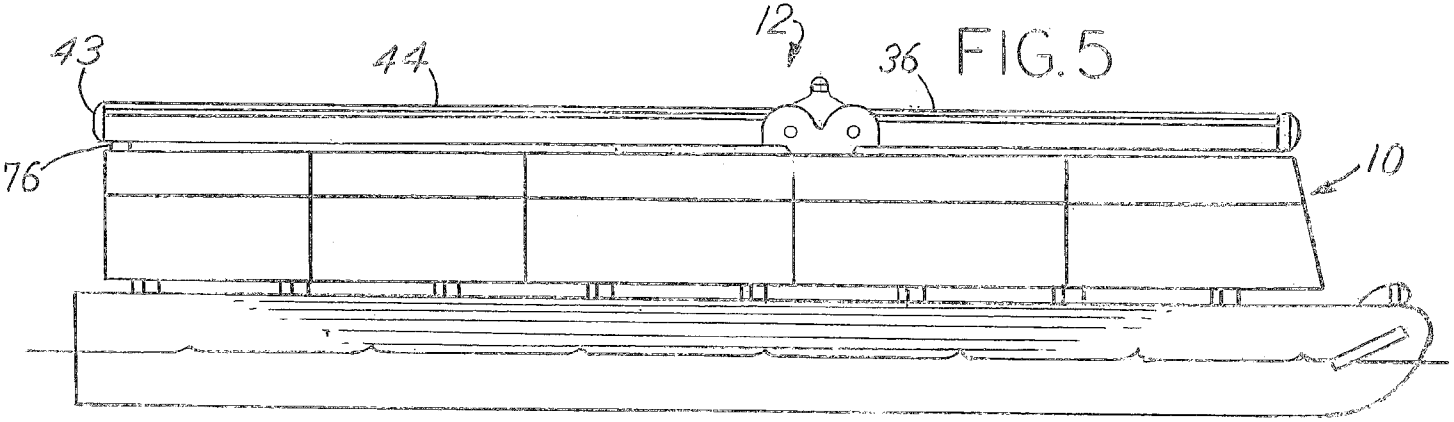
FIG. 5 is a side view of the cover in the covered position.

A retractable cover 12 can be attached to any number of vehicles or areas where a stowable cover is desirable. In this example, a boat 10 with an open top and retractable cover 12 is shown in FIGS. 1 through 5. As is visible in top view FIG. 9, sections of the cover 12 are movable between a retracted position and an extended position. In the retracted position, the sections are fully retracted and stored inside a center section 14 as shown in FIG. 2. In the extended position shown in FIGS. 4 and 5, front fabric 36 extends forward and rear fabric 44 extends rearward from center section 14. The retractable cover 12 is mounted to the boat 10 between the front and rear of the boat 10 as shown in FIG. 1. The center section 14 can move between a lowered position and a raised position using a lifting mechanism 90.

Figure 12:
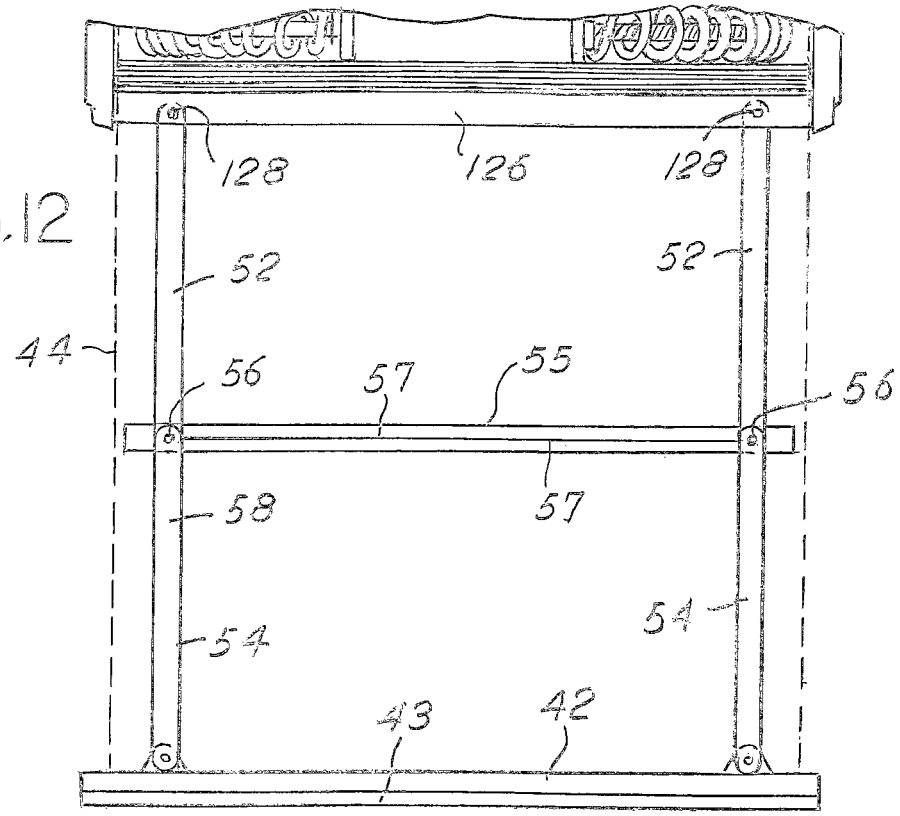
FIG. 12 is a partial view of the mechanism in FIG. 11 showing an intermediate beam and the rear beam fully extended.

Turning now to the details of the center section 14, a forward beam 20 is an elongate structural member and has a front fabric 36 attached along its length. The forward beam 20 is shown curved with ends 22 facing rearward as in FIG. 9. The curved nature of the forward beam 20 is directly related to the shape of the area the cover is intended to protect. It is contemplated that the forward beam 20 is straight. The forward beam 20 is curved downward near ends 22. Near the ends 22 are linkage attachment points 24 where a forward linkage 26 attaches. The forward linkage 26 is made from two elongate members 28, 30 which are connected to each other at a central pivot point 34. Each outer member 28 of the linkage 26 has a strut attachment point 32 that is near its central pivot point 34. This detail is visible in FIG. 9. Affixed to the forward beam 20 between the ends 22 and extending rearward is a forward fabric 36. The forward fabric 36 has lateral edges and extends and retracts from a center section 14, specifically a front roller 60. The forward fabric 36 has an outer edge affixed to the forward beam 20. The forward linkage 26 supports the weight of the forward beam 20 and the forward fabric 36. Optionally, an intermediate beam is attached to the forward linkage at the central pivot point 34 and allows the central pivot point 34 to slide in a channel as the forward linkage moves from a refracted position to an extended position. The intermediate beam is curved downward near ends similarly to the forward beam 20. The intermediate beam supports the forward fabric 36 to help maintain the downward curvature of the forward fabric 36, allowing rainwater to drain as shown in FIG. 10 and preventing pooling in an otherwise unsupported area. The intermediate beam for the rearward linkage is shown in FIG. 12 for reference. The intermediate beam for the forward linkage would be similar in form and function.

Figure 9:
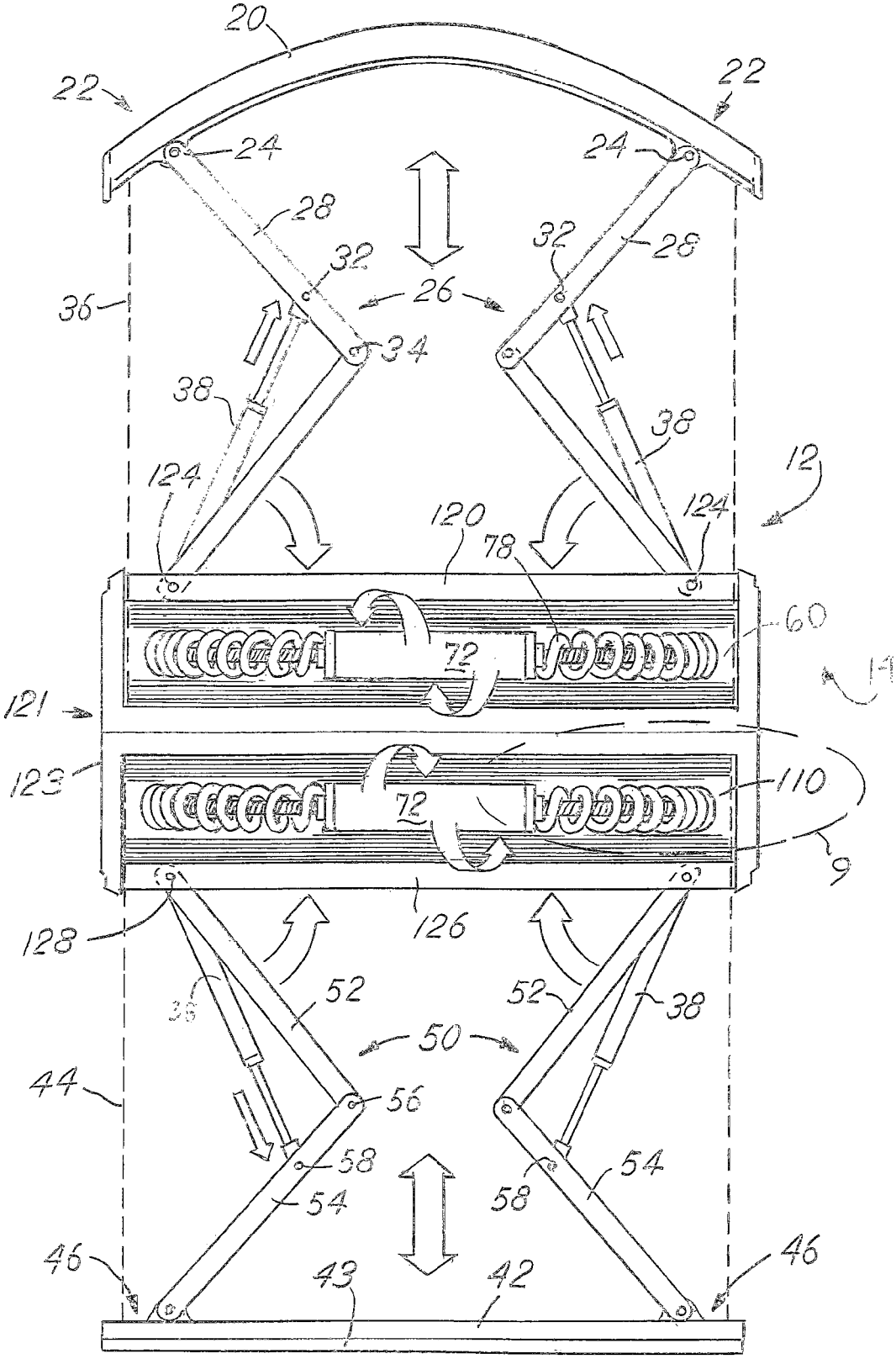
FIG. 9 is a top view of the mechanism located between an extended position and a refracted position with the center cover and fabric as transparent.
Figure 10:
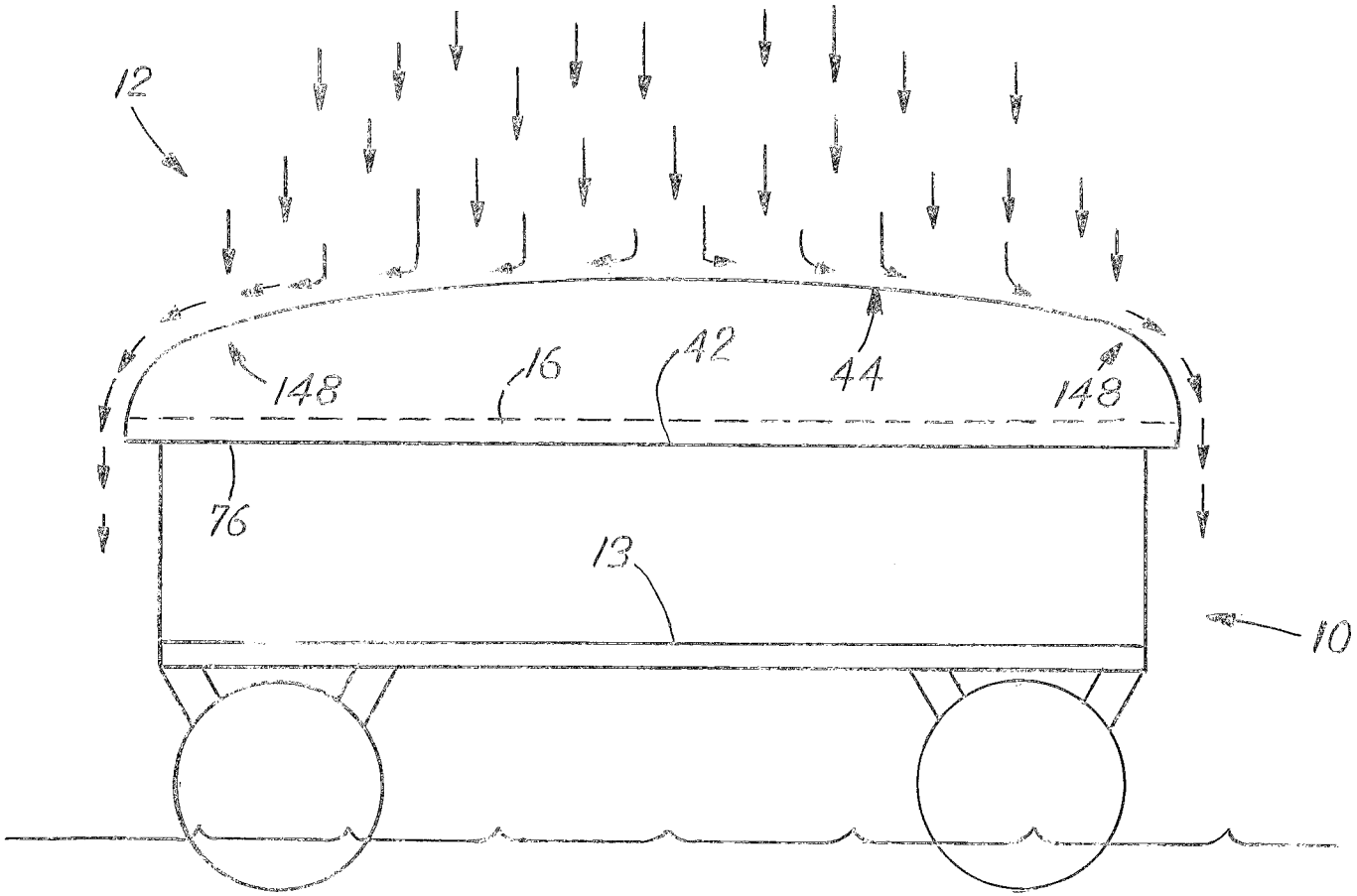
FIG. 10 is a rear view of the cover in the covered position on a pontoon boat showing how rainwater and other material would be shed from the cover.
Figure 11:
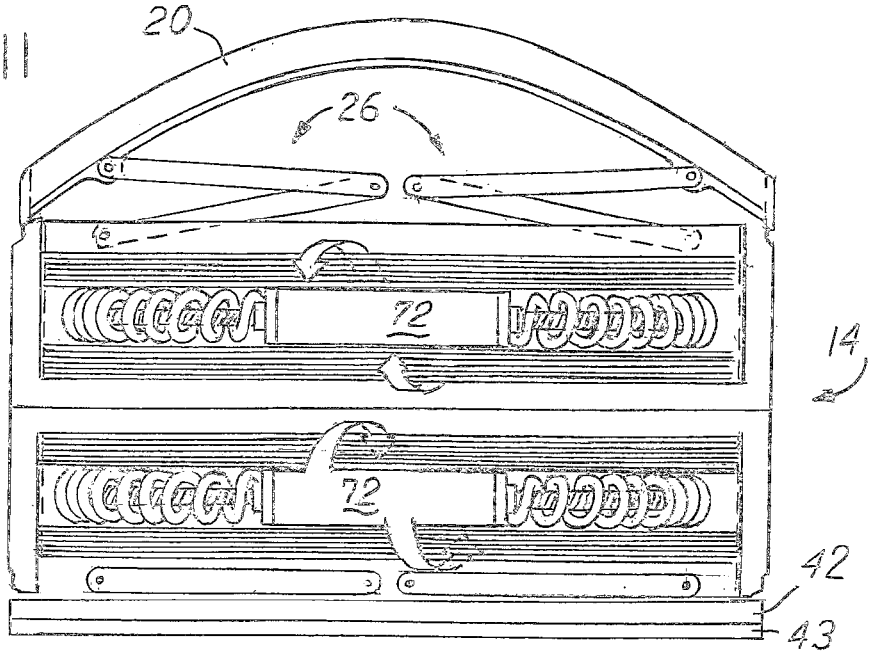
FIG. 11 is a top view of the mechanism in FIG. 9 with the front and rear beam in the refracted position.

As shown in FIG. 9, rear beam 42 is an elongate structural member with downward curvature near ends 46. A rear fabric 44 attached along its length between ends 46 and extends forward to center section 14. Near the ends 46 are linkage attachment points 48 where a rearward linkage 50 attaches. Much the same as forward linkage 26, rearward linkage 50 is made from two elongate members 52, 54 which are connected to each other at a central pivot point 56. This detail is shown in FIG. 9. Affixed to the rear beam 42 between the ends 46 and extending rearward is a rear fabric 44. The rear fabric 44 has lateral edges and extends and retracts from a center section 14, specifically a rear roller 110. The rear fabric 44 has an outer edge attached to removable beam 43. The removable beam 43 attaches to the rear beam 42. The rearward linkage 50 supports the weight of the rear beam 42, the removable beam 43, and the rear fabric 44. Optionally, an intermediate beam 55 is attached to the rear linkage at the central pivot point 56 and allows the central pivot point 56 to slide in a channel 57 as the rear linkage moves from a retracted position to an extended position. The intermediate beam 55 is curved downward near ends similarly to the rear 42 and removable beam 43. The intermediate beam 55 supports the rear fabric 44 to help maintain the downward curvature of the rear fabric 44, allowing rainwater to drain as shown in FIG. 10 and preventing pooling in an otherwise unsupported area. This is visible in FIG. 12. A strut attachment point 58 is located on the outer elongate member 54, located near the center pivot point 56.

The center section 14 has a frame 121, cover 18, front roller 60, and a rear roller 110 that are rotatable. The frame 121 has a front section 120, a rear section 126, and sides 123. The front roller 60 is located forward of the rear roller 110. The forward fabric 36 spans between the front roller 60 and the forward beam 20. The rear fabric 44 spans between the rear roller 110 and the rear beam 42, 43. The front frame member 120 of the center section has pivot points 124 where the forward linkage 26 attaches, specifically the inner member 30. Additionally, an expandable strut 38 is affixed to pivot point 124 on one end and strut attachment point 32 on the other end. As the forward linkage 26 is extended and straightened, the strut 38 elongates and the forward beam 20 moves further away from the front roller 60. Struts 38 are gas charged and provide a linear force outward between the mounting ends of the strut 38 as is commonly known in the art. As shown in FIG. 12, the linkage would extend out completely. Additionally, the strut 38 could be a spring loaded expanding mechanism. Optionally, the linkage 26, 50 could be extended or refracted manually or with a motor. In a manual or motorized linkage setup, the strut 38 would be optional. The forward beam 20, forward linkage 26 and strut 38 are all supported by the front frame member 120. As the forward linkage 26 is folded, the central pivot point 34 moves inward and rearward toward the middle of the front frame member 120 along with the strut 38 compressing to a shortened length. When the forward linkage 26 is folded completely, the forward beam 20 is closest to the front frame member 120 and the members 28, 30 are parallel to the forward beam. The pivot point 34 can be offset to allow the inner member 30 and outer member 28 in the forward linkage 26 to fold flat against each other. The rear frame member 126 has pivot points 128 where the rearward linkage 50 attaches. Additionally, expandable struts 38 are attached at pivot points 128. Rearward linkage 50 is similarly a mirror image of the forward linkage 26, with central pivot point 56. As with the forward linkage, the rear beam 42 becomes closest to the rear frame member 126 as the rear linkage 50 is folded completely.

Figure 6:
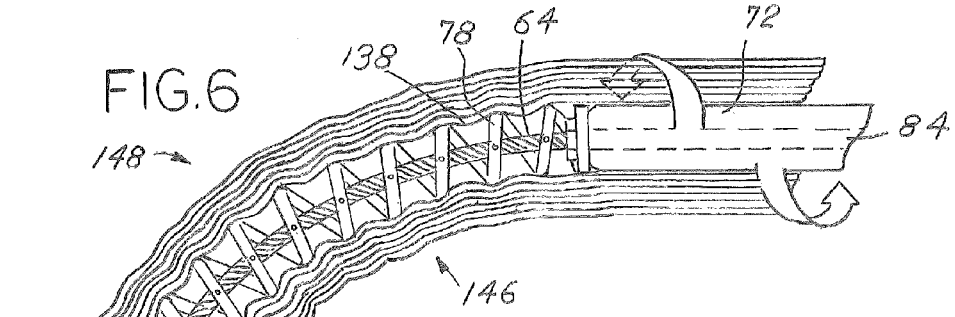
FIG. 6 is a front section view of a curved portion of the roller mechanism.
Figure 7:
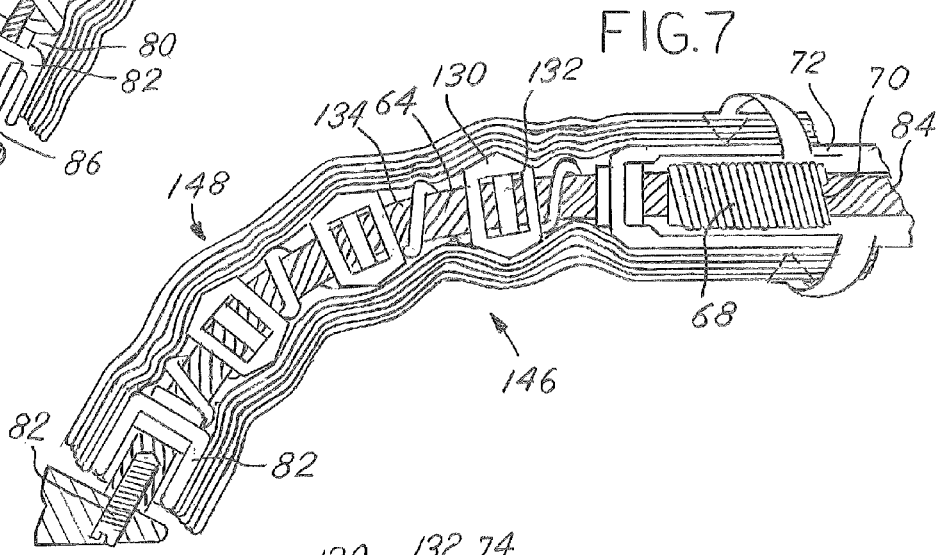
FIG. 7 is a front section view of another embodiment of the curved portion of the roller mechanism.
Figure 8:
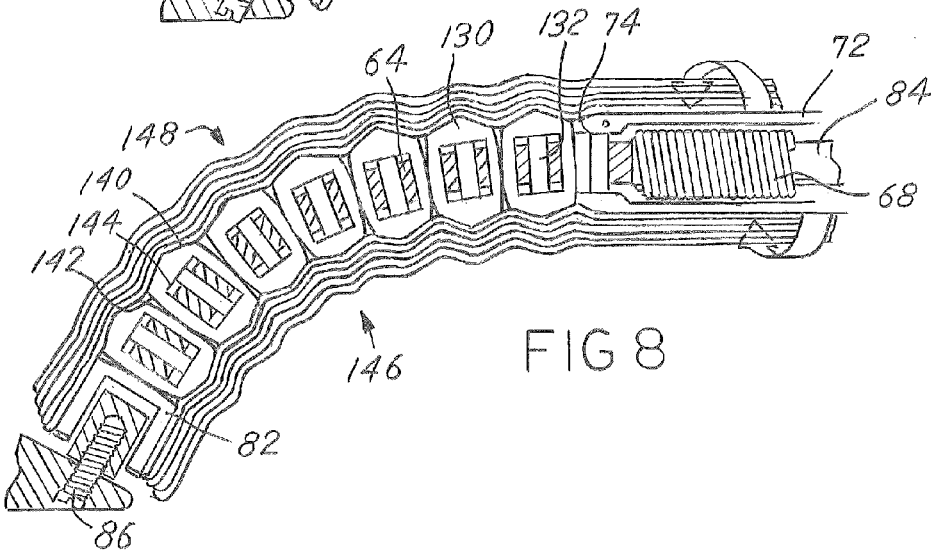
FIG. 8 is a front section view of another embodiment of the curved portion of the roller mechanism.

Turning now to the details of the rollers 60, 110, a front roller 60 holds forward fabric 36 wound and a rear roller 110 where the rearward fabric 44 is wound. One of the curved portions of the roller is shown in FIGS. 6 through 8. One side is shown as an example; the other side is a mirror image. Front roller 60 is rotatable about a center shaft 64. A torsion spring 68 is affixed to the center shaft 64 roughly centered at a central affixation point 70 to generate torque on the front roller 60. Viewing the front roller 60 from the starboard side as in FIGS. 1 through 5, tension is created on fabric 36 by the roller 60 generating torque in the counterclockwise direction. The torque generates tension in the fabric 36 between the forward beam 20 and the front roller 60. The rotating end of the torsion spring 68 winds the front fabric 36 around the front roller 60 as the forward beam 20 is pulled closer to the center section 14. The right torsion spring is not pictured in the FIGS. but the right side is a mirror image. The side pictured is wound one direction and the left torsion spring 68 is wound the opposite direction. The opposite winding of the torsion springs 68 allow a singular central affixation point 70 for the inner ends of the torsion springs 68 to the center shaft 64. It is contemplated that a single spring is necessary. The front roller 60 has a straight tubular section 72 that extends beyond the torsion springs 68. At the ends of the tubular section 72, movable ends of the torsion springs 68 are attached. Optionally a motor instead of torsion springs 68 can be used to extend and retract the forward fabric 36. Past the ends 74 of the tubular section 72 and affixed thereto is a flexible rotary fabric support 78 that rotates in conjunction with tubular section 72 as shown in FIGS. 6-8. Located at the opposite end of the fabric support 78 is a bearing 80 that is affixed to a collar 82. The tubular section 72, fabric support 78, bearing 80, and collar 82 all rotate together around the center shaft. The center shaft has a straight portion 84 and a curved portion 64. The center shaft 64, 84 must be strong enough to withstand the reaction rotational force from the fabric retraction spring or motor. The straight portion 84 is coaxial to the straight tubular section 72. A curved portion 64 extends from the end of the straight portion 84 and is locked from rotation. The curved portion 64 is curved downward and provides the center support for bearing 80. The curved portion 64 must be sufficiently rigid to retain its shape and the location of the straight tubular section 72. Past the bearing 80 is a shaft mount 86 where the curved portion is attached. The shaft mount 86 is affixed to the sides 123 and to a roll support 88. The curved portion 64 is encircled by the fabric support 78 such that as the front roller 60 rotates, the fabric support 78, collar 82, and outer race of the bearing 80 all rotate in conjunction. The curved portion 64 maintains a downward slope to the fabric support and therefore the forward fabric 36 curves downward near the edges as it is rolled and unrolled on the front roller 60. The roll support 88 is attached to the sides 123 of the center section 14.

The rear roller is 110 is similarly constructed as the front roller 60, but in this embodiment, it is sprung oppositely to generate tension on rear fabric 44. Viewing the rear roller 110 from the starboard side, tension is created by the roller pulling in the clockwise direction. With the exception of the previously mentioned differences, all of the other construction and parts of the rear roller are similar to the front roller 60.

The detail of the curved portion of the roller is shown in FIG. 6. The roll support 88 is attached to sides 123 of the frame 121 of the center section 14. The roll support 88 on one side of the center section 14 supports one side of the roller, and the roll support 88 on the other side of the center section 14 supports the opposite side. The roll supports face upwardly from the frame 121. The curved portion 64 is affixed to the shaft mount 86 and is sufficiently rigid such that torque applied from one end of the shaft to the other end does not result in rotation between the ends. The curved portion 64 spans between roll supports 88 on both sides and does not rotate. The curved portion 64 forms an axis of rotation for the fabric support 78 and center cover 18.

The fabric support 78 is shown as a coil spring shaped member in FIG. 6, but can take other forms to accomplish the same task. For example, in FIG. 7, the fabric support has bushings 130 that are separated by coil spring segments 134 that are in contact with ends 142 of adjacent bushings 130. The coil spring segments 134 maintain separation of bushings 130. In FIG. 8, the fabric support 78 is made from a stack of bushings 130 that are supported by bearings 132. The bushings 130 are cylindrical shaped with ends 142, a crowned outer surface 140, and an inner bearing support surface 144. The ends 142 have a thrust surface to maintain spacing of adjacent bushings 130, such as shown in FIG. 8. A cover 138 surrounds the bushings 130, straight tubular section 72, coil spring segments 134, and collar 82. The cover 138 has a fabric attachment section 136 where forward fabric 36 or rear fabric 44 is attached. The forward fabric 36 spans between the forward beam 20 and the fabric attachment section 136 on the forward roller 60. The rear fabric 44 spans between the rear beam 42 and the fabric attachment section 136 on the rear roller 110. Torque generated by the tubular section 72 transmits to tension in the cover 138. As the roller begins to rotate, the fabric 36, 44 is pulled by the fabric attachment section 136 on the cover 138. As the roller continues to rotate, the fabric begins to wind around the cover 138. Because the cover 138 circumscribes the curved portion 64 and fabric support 78, it is a flexible material that can conform to the curvature created by the curved portion 64. This can cause the inward curved portion 146 to bunch up as shown in FIGS. 6 through 8. The cover provides support to prevent the fabric 36, 44 from being pinched and torn against springs 134 or where sides 142 of bushings 130 meet. On the outward curved portion 148, the cover provides support to prevent the fabric 36, 44 from reaching down and touching the curved portion 64. As the cover 138 rotates, the inward curved portion 146 rotates around and becomes the outward curved portion 148 cover 138.

A lifting mechanism 90 spans between a mounting 104 and the center section 14 and moves the center section 14 from a stored position to a use position and finally a covered position. The movement of the lifting mechanism 90 is shown in FIGS. 1 through 5. The mechanism is made up of two struts 91, 92 that have similar lengths. The front strut 92 is attached to the mounting 104 at a pivot point 98 and to the center section 14 at a second pivot point 100. Likewise, the rear strut 91 is attached to the mounting 104 at a pivot point 96 and to the center section 14 at a second pivot point 102. The pivot points 96, 98 are spaced apart similarly to the second pivot points 100, 102. Because of the spacing of the pivot points and the lengths of the front and rear struts 91, 92, the center section 14 remains parallel to the boat 10 within an angular range of the lifting mechanism 90. To have complete coverage of the boat 10, the center section can be moved fully forward where it contacts an upper surface 76 of a railing. FIG. 4 shows the center section 14 nearing the fully forward position. In the fully forward position, the rear fabric 44 and rear linkage 50 are fully extended as well as the front fabric 36 and front linkage 26. The deck 13 is shielded from the elements by the rear fabric 44, the center section 14, and front fabric 36. In the fully shielded position of the cover, rainwater and other falling debris is naturally guided to the sides and down as is shown in FIG. 8.

The lifting mechanism 90 is moved manually or with the assistance of a motor and is counterbalanced with weight or spring force. For positioning, the motor and gear train will lock the mechanism 90 in position when stopped. For a non-motorized manual installation, the mechanism 90 has either detents to lock the mechanism or has a lockable element that can fix the lifting mechanism 90 in specific positions.

To deploy the cover for shade use, the center section starts at a stored position with the front and rear sections fully retracted as shown in FIG. 1. The lifting mechanism 90 lifts and moves the center section forward and upward to a position desired by the user. After the center section 14 is positioned, the forward beam 20 is moved forward towards the front of the boat. As the forward beam is moved forward, the front fabric 36 unwinds from the front roller and the forward linkage 26 expands with the aid of the struts 38 as shown in FIG. 2. The user may also desire to have shade behind the center section. At that point, the rear beam can be moved rearward. As the rear beam is moved rearward, the rear fabric 44 unwinds from the rear roller and the rearward linkage 50 expands with the aid of the struts 38.

To deploy the cover for storage use, the center section starts at a stored position with the front and rear sections fully retracted as shown in FIG. 4. The lifting mechanism 90 lifts and moves the center section forward while the removable beam 43 is detached from the rear beam 42. The removable beam 43 is then attached to a hook 16 located rearward. This causes the rear fabric 44 to unwind from the rear roller and the rearward linkage 50 expands with the aid of the struts 38. The forward beam 20 is moved forward towards the front of the boat. As the forward beam 20 is moved forward, the front fabric 36 unwinds from the front roller 60 and the forward linkage 26 expands with the aid of the struts 38 as shown in FIG. 4. The lifting mechanism 90 moves completely forward and rests on the upper surface of a railing 76. The forward beam 20 comes to rest at the front portion of the boat over the upper surface 76 of the railing. The lock is then engaged to secure the forward beam to the railing 76. Optionally the center section can be locked to the railing 76 for added security.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A retractable cover affixed to a structure having an open space, said open space having a deck with a perimeter, said perimeter defining an open area, said cover having:

a center section having a front roller, said front roller having a front inner shaft having curved portions at distal ends and a straight portion located therebetween and affixed to a frame at said distal ends, a rotatable outer portion circumscribing said front inner shaft, said rotatable outer portion having flexible portions circumscribing said curved portions of said front inner shaft and a straight portion circumscribing said straight portion of said front inner shaft, said front roller having a front fabric having an inner edge affixed to said rotatable outer portion;

said center section having a rear roller, said rear roller having a rear inner shaft having curved portions at distal ends and a straight portion located therebetween and affixed to said frame at distal ends, a rotatable outer portion circumscribing said rear inner shaft, said rotatable outer portion having flexible portions circumscribing said curved portions of said rear inner shaft and a straight portion circumscribing said straight portion of said front inner shaft, said rear roller having a rear fabric having an inner edge affixed to said rotatable outer portion;

a front section having an elongate front beam curved downward near distal ends, said front fabric having an outer edge affixed along a lateral edge of said front beam, a front folding linkage connecting said front beam to said center section and having an outer end pivotably affixed to said front beam at an outer end and having an inner end pivotably affixed to said center section at an inner end, said front folding linkage having a center pivot point located intermediate said inner and outer end;

a rear section having an elongate rear beam curved downward near said distal ends, said rear fabric having an outer edge releasably affixed along a lateral edge of said rear beam, a rear folding linkage connecting said rear beam to said center section and having an outer end pivotably affixed to said rear beam at an outer end and having an inner end pivotably affixed to said center section at an inner end, said rear folding linkage having a center pivot point located intermediate said inner and outer end;

a lifting mechanism having a mounting portion affixed to said structure on one end and affixed to said center section at a second end, said lifting mechanism moveable between a rearward stored position and a forward covered position, said rearward stored position defined by said center section located rearward said mounting portion, said forward covered position defined by said center section located forward said mounting portion;

said front section moveable between a retracted position and an extended position, said retracted position defined by said front beam located relatively near said center section, said extended position defined by said front beam located relatively far from said center section; and said rear section moveable between a retracted position and an extended position, said retracted position defined by said rear beam located relatively near said center section, said extended position defined by said rear beam located relatively far said center section.

2. The retractable cover of claim 1, further comprising a coil spring having a fixed end affixed to one of said inner shafts and a rotating end affixed to said outer portion circumscribing said inner shaft to which said coil spring is attached, said spring urging the corresponding said fabric attached toward said center section.

3. The retractable cover of claim 1, wherein said perimeter having a rear attachment adapted to affix said rear beam when said lifting mechanism is in said covered position.

4. The retractable cover of claim 1, wherein said flexible portions of said front outer portion comprising a series of bushings.

5. The retractable cover of claim 1, wherein said flexible portions of said rear outer portion comprising a series of bushings.

6. The retractable cover of claim 1, wherein said flexible portions of said front outer shaft comprising a fabric support.

7. The retractable cover of claim 1, wherein said front and rear roller each having a corresponding retraction mechanism urging said outer edge of said corresponding fabric toward said corresponding front and rear roller.

8. The retractable cover of claim 1, wherein said front and rear folding linkage each having a corresponding expandable strut affixed thereto, each said corresponding strut urging said corresponding folding linkage toward said extended position.

9. The retractable cover of claim 1, wherein said front section having an intermediate beam, said center pivot point of said front section is slidable along said intermediate beam.

10. The retractable cover of claim 9, wherein said rear section having an intermediate beam, said center pivot point of said rear section is slidable along said intermediate beam.

* * * * *